US007628204B2

(12) United States Patent
Iqbal et al.

(10) Patent No.: US 7,628,204 B2
(45) Date of Patent: Dec. 8, 2009

(54) WASTEWATER DISPOSAL WITH IN SITU STEAM PRODUCTION

(75) Inventors: Rashid Iqbal, Houston, TX (US); Vikram Rao, Houston, TX (US); Odette Eng, Sugar Land, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 230 days.

(21) Appl. No.: 11/600,551

(22) Filed: Nov. 16, 2006

(65) Prior Publication Data

US 2008/0135241 A1 Jun. 12, 2008

(51) Int. Cl.
*E21B 43/24* (2006.01)

(52) U.S. Cl. ..... 166/272.3; 166/266; 166/57

(58) Field of Classification Search ..... None
See application file for complete search history.

(56) References Cited

U.S. PATENT DOCUMENTS 3,373,814 A * 3/1968 Eilers et al. ..... 166/288
3,482,630 A * 12/1969 Earlougher, Jr. ..... 166/260
3,931,006 A * 1/1976 Baillie et al. ..... 210/800
4,333,529 A * 6/1982 McCorquodale ..... 166/267
4,377,205 A 3/1983 Retallick
4,388,892 A 6/1983 Rody
4,399,039 A * 8/1983 Yong ..... 210/728
4,478,280 A * 10/1984 Hopkins et al. ..... 166/260
4,574,886 A * 3/1986 Hopkins et al. ..... 166/272.3
4,706,751 A 11/1987 Gondouin
5,458,193 A * 10/1995 Horton et al. ..... 166/260
6,129,148 A 10/2000 Meeks
2004/0055208 A1* 3/2004 Chakrabarty et al. ..... 44/301

* cited by examiner

*Primary Examiner*—Jennifer H Gay
*Assistant Examiner*—Angela M DiTrani

(57) ABSTRACT

Oil-contaminated clay dispersions in final tailings pond water from a bitumen extraction operation are used in downhole catalytic steam production for an in situ process such as SAGD to produce bitumen. The final tailings pond water is thus disposed of in an environmentally acceptable manner and a suitable source of water is made available for steam generation and subterranean injection.

21 Claims, 1 Drawing Sheet

WASTEWATER DISPOSAL WITH IN SITU STEAM PRODUCTION

CROSS REFERENCE TO RELATED APPLICATIONS

FIELD

The present embodiments relate generally to the disposal of water containing emulsified oil, colloidal solids, and the like or a combination thereof, for in situ steam production.

BACKGROUND

Tar sands, also known as oil sands and bituminous sands, are sand deposits which are impregnated with dense, viscous petroleum. One method for recovering bitumen or heavy oil from such tar sands is the so-called hot water extraction process or hot caustic extraction process. In such a process, the tar sand feed is heated and mixed with water or water plus caustic to separate heavy oil or bitumen from sand. The oil/water/sand mixture is screened and introduced into settlers, one of which settles sand down to be removed as tailings, and the other of which floats the bitumen to be removed as froth. A mostly water middlings stream with some suspended fine mineral and bitumen particles is removed from the settlers, and mostly recycled to the extraction drum, except for a drag stream that is withdrawn as a purge to control the concentration of fines and contaminants in the middlings. After further treatment to recover additional bitumen and remove most of the sand, the aqueous tailings are sent to the final tailings pond.

The final tailings produced from the extraction of oil from a tar sands mining operation can contain an almost permanent dispersion of colloidal sand particles coated with bitumen in water. Since separating the solids and heavy oil from the wastewater can be nearly impossible, the aqueous tailings can be accumulated for future treatment in large retention ponds. Some of the tailings have been in tailings ponds for as long as forty years so far. Water from a typical final tailings pond can have a pH from 6 to 8, a dispersed solids content from 1 ppm by weight up to 25 weight percent or more, and a hydrocarbon content from 0.1 to 5000 ppm wt.

The tailings pond water that can be recycled to the extraction unit as process water has been limited because salts and other undesirable minerals accumulate therein. The tailings pond water can include hydrocarbons and other contaminants so that it cannot be introduced into waterways, or used in boilers to generate steam.

Similar wastewater streams including colloidal dispersions and/or oil emulsions can be produced from other mining operations, refineries and hydrocarbon upgrading operations. The waste waters from operations such as these described can be contaminated with clay, minerals and oils and can not be discharged to water sources such as rivers.

Steam can be employed downhole in wellbores for various purposes, such as to heat the petroleum and make the petroleum flowable either in the wellbore or from the formation. For example, steam can be injected into the bitumen containing tar sands in the bitumen or heavy oil production method known as steam assisted gravity drainage (SAGD). Steam can be injected in one or more injection wells completed in the heavy oil formation. The steam heats the heavy oil in situ, reducing the viscosity thereof and rendering the heavy oil flowable. The flowable heavy oil can then be produced at one or more production wells. However, obtaining water for production of injection steam can be difficult, and poses a potential problem for production of oil using SAGD production techniques.

In situ steam generators where fuel, oxidant and water can be supplied to a surface or downhole steam generator can more effectively produce steam at the desired location, thereby avoiding heat losses arising from distribution from a remote steam source to the wellbore, and in the case of subsurface steam generation, between the surface and the injection stratum.

A need exists for both for treatment and/or disposal of the tailings pond water from bitumen mining or similar sources, and for an alternative to a fresh water source to generate steam in situ for operations such as steam assisted gravity drainage (SAGD) processes and other steam assisted thermal processes for production of heavy oils.

BRIEF DESCRIPTION OF THE DRAWINGS

The detailed description will be better understood in conjunction with the accompanying drawings as follows.

Figure 1:
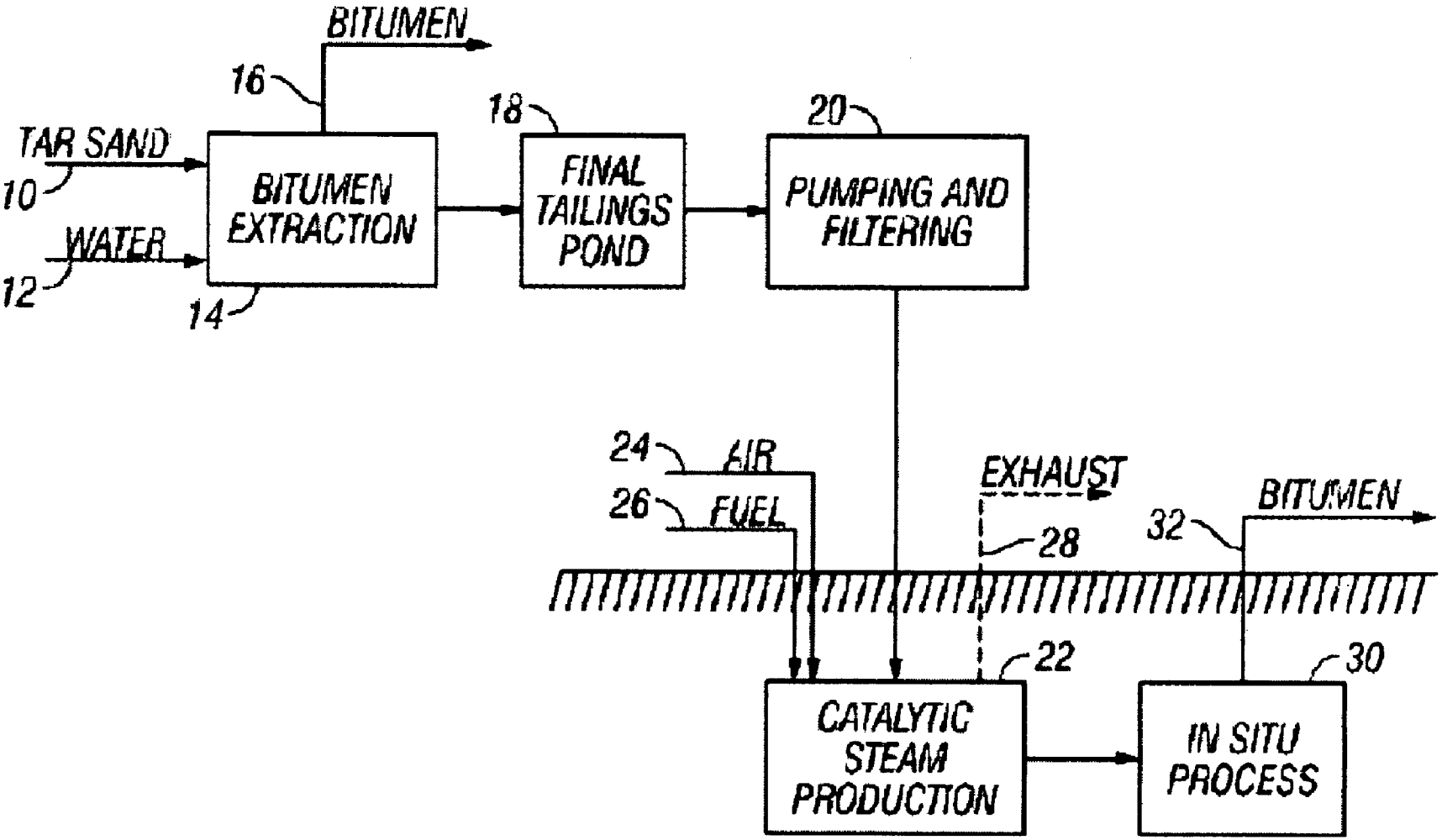
FIG. 1 depicts a simplified flow diagram for an embodiment in which tailings pond water from a mined tar sands extraction operation can be used to catalytically produce steam in situ for a steam assisted gravity drainage process.

The present embodiments are detailed below with reference to the listed FIGURES.

DETAILED DESCRIPTION OF THE EMBODIMENTS

Before explaining the present embodiments in detail, it is to be understood that the embodiments are not limited to the particular embodiments and that they can be practiced or carried out in various ways.

One embodiment of a steam production process includes supplying fuel, oxidant and an aqueous dispersion of hydrocarbon-bearing particles to a steam generator, promoting combustion in the steam generator to produce steam comprising particulates from the dispersion, and consuming the steam at an in situ process destination.

In an embodiment, the hydrocarbon-bearing particles in the dispersion can include silica, and the hydrocarbons can be bitumen, heavy oil or a combination thereof. The aqueous dispersion can be colloidal. Colloidal can refer to mixtures of colloidal particles with larger particles having diameters up to 100, 200 or 300 microns or more. In one example embodiment, the aqueous dispersion can have at least 5 volume percent of particles in the colloidal dispersion are less than 1 micron. The dispersion can contain from 1 ppm by weight to 25 percent by weight inorganics and from 0.1 to 5000 ppm wt hydrocarbons, based on the weight of the total dispersion supplied to the steam generator.

The process can include, in an embodiment, pumping the aqueous dispersion from a tar sands tailings pond. In another embodiment, the process can include removing macroscopic particles from the dispersion prior to supply to the steam generator. The particle removal can include filtration to remove particles greater than 3 microns.

In an embodiment, the combustion can be catalytically promoted. The hydrocarbon in the dispersion can be oxidized in the combustion in one embodiment. The steam consumption destination can be a subterranean formation adjacent an injection well. The steam generator can be disposed downhole in the injection well or on the surface. The particles entrained in the steam can be smaller than pores in the subterranean formation, i.e., the formation can be permeable to the steam-particle mixture. The subterranean formation can contain deposits of bitumen or heavy oil. Flow of the bitumen or heavy oil in the subterranean formation can be facilitated by heating from the steam introduction, and in an embodiment, the heated bitumen or heavy oil can be produced from a production well.

In one embodiment, the steam generation can include indirect heating of the dispersion and venting of combustion gases from the steam generator. Alternatively, the steam generation can include direct heating of the dispersion and introduction of the combustion gases from the steam generator with the steam to the in situ steam consumer.

In another embodiment, a bitumen or heavy oil recovery process includes pumping a colloidal dispersion from a tar sands tailings pond, wherein the colloidal dispersion comprises from 1 ppm wt to 25 weight percent inorganics and from 0.1 to 5000 ppm wt hydrocarbons, based on the weight of the colloidal dispersion, and particles in the dispersion comprise at least 5 volume percent less than one micron. Macroscopic particles can be removed from the colloidal dispersion to form a pretreated colloidal dispersion. Fuel, oxidant and the pretreated colloidal dispersion can be supplied to a steam generator. In another step, combustion can be promoted in the steam generator to produce steam having particulates entrained from the colloidal dispersion, and the steam from the steam generator is introduced to a subterranean formation comprising bitumen or heavy oil, wherein the formation is permeable to the entrained particulates. The process can heat the bitumen or heavy oil in the formation to make it flowable, and the flowable bitumen or heavy oil can be produced from a production well.

Another embodiment provides a heavy oil or bitumen recovery system including a tar sands tailings pond comprising a colloidal dispersion comprising from 1 ppm wt to 25 weight percent inorganics and from 0.1 to 5000 ppm wt hydrocarbons, based on the weight of the colloidal dispersion, and particles in the dispersion comprising at least 5 volume percent less than one micron. The system can include a pump to pressurize the colloidal dispersion, a large particle removal unit to remove macroscopic particles from the colloidal dispersion and form a pretreated colloidal dispersion, and respective lines to supply fuel, oxidant and the pretreated colloidal dispersion to a steam generator to produce steam having particulates entrained from the colloidal dispersion. An injection well can introduce the steam from the steam generator to a subterranean formation comprising bitumen or heavy oil, wherein the formation is permeable to the entrained particulates, to heat the bitumen or heavy oil in the formation to make it flowable in the formation. A production well can receive and produce the flowable bitumen or heavy oil from the formation.

In one embodiment, the heavy oil or bitumen recovery system can include a tar sands extraction system to produce heavy oil or bitumen and a final tailings stream to supply the colloidal dispersion to the tailings pond.

In the hot water extraction process or hot caustic extraction process, the bulk of sand in a feed can be removed from the bottom of a separation cell as tailings. A major portion of bitumen in the feed floats to the surface of the separation cell and can be removed as froth. A middlings stream including mostly water, but with some suspended fine mineral and bitumen particles, can be the third stream removed from the separation cell. A portion of the middlings can be returned for mixing in an extraction drum to dilute the separation cell feed properly for pumping.

The balance of the middlings is called a drag stream. The drag stream can be withdrawn from the separation cell to be rejected after processing in scavenger cells. The drag stream can be primarily used as a purge to control the fines and contaminants concentration in the middlings. The drag stream can be further treated in scavenger cells to recover additional bitumen. Tailings after removal of most of bitumen and sand are sent to a final tailings pond.

With reference to FIGURES, FIG. 1 depicts a simplified flow diagram for an embodiment in which tailings pond water from a mined tar sands extraction operation can be used to catalytically produce steam in situ for a steam assisted gravity drainage process. Tar sands 10 can be mined and extracted with water 12 in an extraction unit 14 to obtain bitumen 16. Wastewater can be collected in a final tailings pond 18. Water from the final tailings pond 18 can be conditioned in a pumping and filtering unit 20 by pumping to an appropriate pressure and filtering to remove larger particles. After filtration, the water can be supplied to a subsurface catalytic steam generator 22 with oxidants including air 24 and fuel 26. Gaseous combustion products can be vented at a surface via an exhaust line 28. Steam can be produced from generator 22 for a steam assisted gravity drainage (SAGD) process or other in situ process 30 to produce a surface stream 32 of petroleum including bitumen, heavy oil, and the like or a combination thereof.

An aqueous colloidal dispersion can be obtained by pumping from a tailings pond of a tar sands extraction operation. While some embodiments use wastewater from the final tailings pond 18 in the process, other embodiments use similarly contaminated water from other sources, including tailings from other mining operations, wastewater from refinery or oil upgrading operations, and the like or combinations thereof.

Solids contents in the dispersion of up to about 25 weight percent, or in various alternative embodiments, up to about 20, 15, 12, 10, 8, 5, 3, 2, 1, 0.5, 0.1, 0.05 or 0.01 weight percent, can be tolerated. The solids can include in some embodiments at least 5, 10, 20, 25, 30, 35, 40, 50, 60 or 80 percent colloidal solids by volume based on the total volume of the solids. The colloidal solids content of water in various embodiments can be above about 5, 10, 100, 200, 300, 500, 1000, 2000 or 5000 ppm or more by weight, or a range from about any lower limit to about any higher upper limit. Similarly, the water can have an oil content up to below a level that can be easily or economically recovered from the water, or up to about 100, 500, 1000, 2000, 2500 or 5000 ppm by weight in alternative embodiments, and can have an oil content too high for other environmentally acceptable disposal without further treatment or from at least 0.1, 0.5, 1, 5, 10, 50 or 100 ppm by weight, or a range from any lower limit to any higher upper limit.

Since the tailings can be disposed of by subsurface injection as steam, the specifications for the tailings may be relaxed and conventional final treatment processes may be made more economical or eliminated. If desired, for example to improve reservoir fluid properties of the steam or condensate generated therewith, additional oil or colloidal particles, or any other additives used in steam or hot water drive fluids, may be added to the water.

The process can include centrifugation, filtration, settling with or without chemical injection, or the like, or a similar unit operation to remove the macroscopic particles from the colloidal dispersion prior to supply to the steam generator. Fines in colloidal tar sand extraction tailings can have a particle size up to about 100, 200 or 300 microns or more. The filtration 20 for supply to catalytic steam production unit 22 can remove large particles which can clog supply lines, accumulate on catalyst surfaces or adversely affect formation permeability or other in situ steam consumer, i.e. non-colloidal particles with a size greater than about 0.1, 1, 3, 5, 10, 20, 50, 100, or 200 microns in various embodiments.

Catalytic steam generators can be adapted for use with tailings water without modification. The steam generator can be a direct heating type through which water can be mixed with reactants or injected into combustion products, in which case any oil present can be oxidized and converted to carbon monoxide, carbon dioxide, water or other oxidation or partial oxidation products, and the like or combinations thereof. Tailings water can be injected into a non-catalytic secondary combustion zone downstream from a primary catalytic combustion zone receiving fuel and oxygen. The steam generator can be located downhole or a the surface, preferably adjacent the injection site. Steam and combustion products can be injected directly into a subterranean formation. Noncondensable gas formation can be reduced by using oxygen or oxygen-enriched air as an oxidant. If the water is indirectly heated, e.g. in a heat exchanger, combustion products can be vented at the surface or otherwise, by return through an exhaust line in the wellbore to the surface if necessary in the case of the subsurface steam generator.

In situ steam generators can employ both catalytic and non catalytic processes for steam production. The so-called flameless combustion improves the reliability and safety of downhole steam generation. Combustion gases can provide heat sources for producing more steam through injection of water. The produced steam can either be separated from flue gas before injection into production wells or can be injected along with the flue gas which provides a higher heat efficiency.

Steam from a generator 22 that is injected into a formation can include entrained colloidal particles that are relatively small compared to the pore throat sizes of the formation, and can be carried along at sufficient velocity to avoid clogging the pores or otherwise inhibit permeability of the formation. As heat is transferred from the steam, a condensate including the entrained colloidal particles can result and bitumen or heavy oil in the heated formation can become less viscous and flowable. In addition, the steam and condensate can be introduced at a relatively higher pressure and serve as a drive to induce oil flow to a production well.

To inhibit the tendency of colloidal particles from plugging interstices of the formation, a tailings water filtrate can be pre-screened by filtration using 3-micron filter paper or the like, to see if a filter cake is formed. Alternatively or additionally, the tailings water filtrate can be screened by pumping through a core sample representative of the formation into which the steam is to be injected, to see if permeability is sufficiently retained for continuous long-term steam injection.

Colloidal particles in an injection fluid can form a condensate with a relatively higher viscosity than colloid-free water, which can under certain circumstances delay water breakthrough and more efficiently drive the flowable oil to a production well. For example, tailings pond water can have a viscosity of from about 3 to about 5 cP at 25° C., compared to about 1 cP for solids-free water. Moreover, the viscosity of the injection fluid can be further increased as a result of thermal treatment and oxidation of the particle surfaces in a combustion process and/or the effect of reservoir conditions on the particles. Further, the presence of the colloidal particles can have an abrasive or scouring effect which can release oil from the interstitial surfaces of the formation rock. The presence of the oil-coated colloidal particles can reduce interfacial surface tension and promote oil entrainment and sweeping of oil from the formation. Oil or colloidal particles accompanying the injected fluid and produced at the production well can be processed with the produced bitumen or heavy oil.

Embodiments can produce steam for in situ processes with oil-contaminated water that cannot otherwise be disposed of. The steam can be produced using catalytic steam generation or other steam generation processes. Clean up of contaminated water can be optional.

If tailings water from a mining operation is used, then minerals, clay and other contaminants that came from oil sands or heavy formation can be returned to an original site to inhibiting environmental impact. The minerals and hydrocarbons in contaminated water can be similar in nature chemically to a subterranean formation into which the water is injected. The particles can be of a colloidal size, smaller than pore throats in such formations. Steam and condensate produced by using fresh water including oil contaminated colloidal particles can be used as a reservoir drive fluid.

In an embodiment, in situ steam production can be employed at a surface to supply the effluent as steam to a turbine for power generation. A relatively small amount of clay in the effluent, which can be less than 1000 ppm by weight of water, can be chemically and physically similar to clay present in fuel oil for example. Particulates, including those over about 1, 5 or 10 microns in diameter, can be removed, for example, by filtration, cyclonic separation, electrostatic precipitation, or the like or a combination thereof, either in the tailings water or in the steam generated therefrom.

In an embodiment, tailings water can be employed in situ in a surface process for coal gasification and/or shift conversion of a resulting gas. Coal gasification can be carried out in a slurry fed reactor or in a transport reactor. In the former case, tailings water can be used to prepare a slurry with coal and fed therewith to a reactor, or in the case of a transport reactor, the tailings water can be fed separately. Solids in the tailings water can be chemically similar to oxides that can be converted to slag or ash in a gasification reactor. In a slagging reactor, fluxing ingredients can be adjusted to modify slag formation. Ash can be removed in downstream ash removal or processing equipment, which can be re-sized to be larger or smaller to accommodate differences in the volume of ash removed. Oil contaminants in the tailings water can be gasified along with the coal.

Tailings water can be used in an embodiment as a reagent in an in situ steam generator for biomass gasification or other conversion to useful products, including ethanol. According to an embodiment of the present invention, the tailings water is supplied with the liquid solution to the gasification apparatus.

Example: A tar sands mining and extraction plant had accumulated final tailings lakes with water suspension. A sample examined upon centrifugation showed a layer of organic material on top of the clay-like solids. Using water evaporation at 105° C and organics removal by methylene chloride extraction, the sample had a water content of 75.10 weight percent, an inorganic solids content of 24.05 weight percent, and an organic solids content of 0.85 weight percent. By X-ray diffraction, the inorganic solids were 40 weight percent quartz, 30 weight percent illite, 22 weight percent kaolin, 4 weight percent potassium feldspar, 3 weight percent plagioclase feldspar and 1 weight percent chlorite. An optically observed particle size distribution with a COULTER counter ranged from 0.1 to 100 microns with a volumetric mean of 12.3 microns and median of 6.876 microns with 10 volume percent less than 0.967 microns, 25 volume percent less than 2.475 microns, 50 volume percent less than 6.876 microns, 75 volume percent less than 16.16 microns, and 90 volume percent less than 31.08 microns.

For disposal, the tailings pond water is pumped to a pressure of 150 to 2000 psia, then filtered in a cartridge filter to remove particles greater than 3 microns, and supplied to a steam generator located at a subsurface depth of 100 meters in a SAGD injection well. Heavy oil is recovered from a production well in communication with the heated region of flowable hydrocarbon deposits in the vicinity of the injection well.

The embodiments are described above with reference to non-limiting examples provided for illustrative purposes only. Various modifications and changes will become apparent to the skilled artisan in view thereof. All such changes and modifications are intended within the scope and spirit of the appended claims and shall be embraced thereby.

What is claimed is:

1. A steam production process, comprising:

supplying fuel, oxidant and an aqueous dispersion comprising one or more hydrocarbon-bearing particles to a steam generator;

promoting combustion in the steam generator to produce steam comprising particulates from the dispersion; and consuming the steam at an in situ process destination.

2. The process of claim 1 wherein the hydrocarbon-bearing particles in the dispersion comprise silica.

3. The process of claim 2 wherein the hydrocarbon-bearing particles in the dispersion comprise bitumen, heavy oil or a combination thereof.

4. The process of claim 1 wherein the aqueous dispersion is colloidal.

5. The process of claim 4 wherein at least 5 volume percent of particles in the colloidal dispersion are less than 1 micron.

6. The process of claim 1 wherein the dispersion comprises from 1 ppm by weight to 25 percent by weight inorganics and from 0.1 to 5000 ppm wt hydrocarbons, based on the weight of the total dispersion supplied to the steam generator.

7. The process of claim 1 further comprising pumping the aqueous dispersion from a tar sands tailings pond.

8. The process of claim 1 further comprising removing macroscopic particles from the dispersion prior to supply to the steam generator.

9. The process of claim 8 wherein the particle removal comprises filtration to remove particles greater than 3 microns.

10. The process of claim 1 wherein the combustion is catalytically promoted.

11. The process of claim 1 wherein a hydrocarbon in the dispersion is oxidized in the combustion.

12. The process of claim 1 wherein the steam consumption destination comprises a subterranean formation adjacent an injection well.

13. The process of claim 12 wherein the steam generator is disposed downhole in the injection well.

14. The process of claim 12 wherein the hydrocarbon-bearing particles are smaller than pores in the subterranean formation.

15. The process of claim 12 wherein the subterranean formation comprises bitumen or heavy oil.

16. The process of claim 15, wherein flow of the bitumen or heavy oil in the subterranean formation is facilitated by heating from the steam introduction, and further comprising producing the heated bitumen or heavy oil from a production well.

17. The process of claim 12 wherein the steam generation is by indirect heating of the dispersion and combustion gases from the steam generator are vented.

18. The process of claim 12 wherein the steam generation is by direct heating of the dispersion and combustion gases from the steam generator are introduced to the subterranean formation with the steam.

19. A subterranean steam injection process, comprising:

pumping a colloidal dispersion from a tar sands tailings pond, wherein the colloidal dispersion comprises from 1 ppm wt to 25 weight percent inorganics and from 0.1 to 5000 ppm wt hydrocarbons, based on the weight of the colloidal dispersion, and particles in the dispersion comprise at least 5 volume percent less than one micron;

removing macroscopic particles from the colloidal dispersion to form a pretreated colloidal dispersion;

supplying fuel, oxidant and the pretreated colloidal dispersion to a steam generator;

promoting combustion in the steam generator to produce steam having particulates entrained from the colloidal dispersion;

introducing the steam from the steam generator to a subterranean formation comprising bitumen or heavy oil, wherein the formation is permeable to the entrained particulates;

heating the bitumen or heavy oil in the formation to make it flowable in the formation; and producing the flowable bitumen or heavy oil from a production well.

20. A heavy oil or bitumen recovery system, comprising:

a tar sands tailings pond comprising a colloidal dispersion comprising from 1 ppm wt to 25 weight percent inorganics and from 0.1 to 5000 ppm wt hydrocarbons, based on the weight of the colloidal dispersion, and particles in the dispersion comprising at least 5 volume percent less than one micron;

a pump to pressurize the colloidal dispersion;

a large particle removal unit to remove macroscopic particles from the colloidal dispersion and form a pretreated colloidal dispersion;

respective lines to supply fuel, oxidant and the pretreated colloidal dispersion to a steam generator to produce steam having particulates entrained from the colloidal dispersion;

an injection well to introduce the steam from the steam generator to a subterranean formation comprising bitumen or heavy oil, wherein the formation is permeable to the entrained particulates, to heat the bitumen or heavy oil in the formation to make it flowable in the formation; and a production well to receive and produce the flowable bitumen or heavy oil from the formation.

21. The heavy oil or bitumen recovery system of claim 20, further comprising a tar sands extraction system to produce heavy oil or bitumen and a final tailings stream to supply the colloidal dispersion to the tailings pond.

* * * * *